US011950637B2

(12) United States Patent
Qiu et al.

(10) Patent No.: US 11,950,637 B2
(45) Date of Patent: Apr. 9, 2024

(54) MOUTHPIECE ASSEMBLY AND ELECTRONIC CIGARETTE

(71) Applicant: Changzhou Patent Electronic Technology Co., LTD., Changzhou (CN)

(72) Inventors: Weihua Qiu, Changzhou (CN); Wanlin Cai, Changzhou (CN)

(73) Assignee: CHANGZHOU PATENT ELECTRONIC TECHNOLOGY CO., LTD., Changzhou (CN)

( * ) Notice: Subject to any disclaimer, the term of this patent is extended or adjusted under 35 U.S.C. 154(b) by 934 days.

(21) Appl. No.: 16/963,243

(22) PCT Filed: May 11, 2018

(86) PCT No.: PCT/CN2018/086434

§ 371 (c)(1),
(2) Date: Jul. 19, 2020

(87) PCT Pub. No.: WO2019/140810

PCT Pub. Date: Jul. 25, 2019

(65) Prior Publication Data

US 2021/0368867 A1 Dec. 2, 2021

(30) Foreign Application Priority Data

Jan. 19, 2018 (CN) ..... 201810054760.9

(51) Int. Cl.

| | |
|---|---|
| ***A24F 7/00*** | (2006.01) |
| ***A24F 40/40*** | (2020.01) |
| *A24F 40/20* | (2020.01) |

(52) U.S. Cl.
CPC ..... *A24F 7/00* (2013.01); *A24F 40/40* (2020.01); *A24F 40/20* (2020.01)

(58) Field of Classification Search
None
See application file for complete search history.

(56) References Cited

U.S. PATENT DOCUMENTS 4,735,217 A 4/1988 Gerth et al.
6,793,104 B2 * 9/2004 Kao ..... B65D 39/0052 222/481.5
2015/0342255 A1 * 12/2015 Wu ..... A61M 15/06 131/329

FOREIGN PATENT DOCUMENTS

CN 104470388 A 3/2015
CN 106723379 A 5/2017
(Continued)

*Primary Examiner* — Ross N Gushi
(74) *Attorney, Agent, or Firm* — Cheng-Ju Chiang

(57) ABSTRACT

Disclosed is a mouthpiece assembly, including a lower mouthpiece cover and an upper mouthpiece cover. The lower mouthpiece cover is provided with a first air inlet passage and a first air outlet passage. The upper mouthpiece cover is provided with an air exiting hole. The upper mouthpiece cover can move relative to the lower mouthpiece cover. When the upper mouthpiece cover is in a first connection state relative to the lower mouthpiece cover, the first air inlet passage is in communication with the outside, and the first air outlet passage is in communication with the air exiting hole; and when the upper mouthpiece cover is in a second connection state relative to the lower mouthpiece cover, the first air inlet passage and the first air outlet passage are closed by the upper mouthpiece cover.

20 Claims, 13 Drawing Sheets

(56) References Cited

FOREIGN PATENT DOCUMENTS

| | | |
|---|---|---|
| CN | 206699395 U | 12/2017 |
| CN | 206791622 U | 12/2017 |

* cited by examiner

MOUTHPIECE ASSEMBLY AND ELECTRONIC CIGARETTE

CROSS REFERENCE TO RELATED APPLICATIONS

This application is a 35 U.S.C. § 371 National Phase conversion of International (PCT) Patent Application No. PCT/CN2018/086434, filed on May 11, 2018, which claims the priority of Chinese Patent Application No. 201810054760.9, filed on Jan. 19, 2018. The contents of the above-identified applications are incorporated herein by reference. The PCT International Patent Application was filed and published in Chinese.

TECHNICAL FIELD

The present invention relates to the technical field of simulated smoking, and in particular, to a mouthpiece assembly and an electronic cigarette.

BACKGROUND

The mouthpiece of the existing electronic cigarette is usually only used as a simple smoking tool for the user. During the smoke generation process, even if the user is not smoking, part of the smoke will flow to the outside from the air outlet and the air inlet of the mouthpiece, causing waste and meanwhile, affecting the surrounding environment.

SUMMARY

In view of the above, it is necessary to provide a mouthpiece assembly capable of switching between the use state and the non-use state.

It is further necessary to provide an electronic cigarette with the mouthpiece assembly.

A first aspect of the present invention provides a mouthpiece assembly. The mouthpiece assembly includes a lower mouthpiece cover and an upper mouthpiece cover. The lower mouthpiece cover is provided with a first air inlet passage and a first air outlet passage. The upper mouthpiece cover is provided with an air exiting hole. The upper mouthpiece cover is movable relative to the lower mouthpiece cover. When the upper mouthpiece cover is in a first connection state relative to the lower mouthpiece cover, the first air inlet passage is in communication with the outside and the first air outlet passage is in communication with the air exiting hole, and when the upper mouthpiece cover is in a second connection state relative to the lower mouthpiece cover, the first air inlet passage and the first air outlet passage are closed by the upper mouthpiece cover.

Further, the lower mouthpiece cover is provided with a recess which is a part of the first air inlet passage. The upper mouthpiece cover includes a main body and a suction part protruding from the main body. When the recess cooperates with the suction part, the first air inlet passage is closed by the upper mouthpiece cover. The air exiting hole is provided on the suction part.

Further, opposite walls of the groove are respectively provided with a first air inlet groove and a second air inlet groove. The first air inlet groove and the second air inlet groove communicate with each other through the recess. The first air inlet groove further communicates with the outside. The first air inlet passage further includes the first air inlet groove and the second air inlet groove.

Further, the upper mouthpiece cover and the lower mouthpiece cover are rotatably connected, or the upper mouthpiece cover and the lower mouthpiece cover are reversibly connected, or the upper mouthpiece cover and the lower mouthpiece cover are slidably connected, or the upper mouthpiece cover and the lower mouthpiece cover are detachably connected.

Further, the lower mouthpiece cover is provided with a first magnetic member. The upper mouthpiece cover is provided with a second magnetic member capable of attracting the first magnetic member with each other.

Further, the lower mouthpiece cover and/or the upper mouthpiece cover are made of an elastic sealing material.

Further, the mouthpiece assembly further includes a first partition plate provided on one side of the lower mouthpiece cover away from the upper mouthpiece cover. The first partition plate is provided with a communicating hole. The lower mouthpiece cover is provided with a communicating groove. Two ends of the communicating groove communicate with the second air inlet groove and the communicating hole respectively. The first air inlet passage further includes the communicating groove and the communicating hole.

Further, when the upper mouthpiece cover is in the first connection state relative to the lower mouthpiece cover, the second magnetic member covers the recess to isolate the recess from the air exiting hole.

A second aspect of the present invention provides an electronic cigarette including the mouthpiece assembly according to any one of the foregoing first aspect. The electronic cigarette further includes an atomizing assembly, and the atomizing assembly is provided with an atomizing chamber.

Further, the electronic cigarette further includes a ventilation assembly connected between the mouthpiece assembly and the atomizing assembly. The ventilation assembly is provided with an air inlet channel and an air outlet channel. Two ends of the air inlet channel communicate with the first air inlet passage and the atomizing chamber, respectively, and two ends of the air outlet channel communicate with the first air outlet passage and the atomizing chamber, respectively.

Further, the electronic cigarette further includes a casing. The mouthpiece assembly and the atomizing assembly are respectively provided at opposite ends of the casing. The ventilation assembly is received inside the casing. An air intake hole is provided in the casing. The air intake hole is in communication with the first air inlet passage and the outside.

A third aspect of the present invention provides a mouthpiece assembly including an upper mouthpiece cover. One end of the upper mouthpiece cover is provided with an air exiting hole, and the other end of the upper mouthpiece cover is provided with a smoke outlet hole communicating with the air exiting hole. A movable member is further provided on the upper mouthpiece cover to match with the smoke outlet hole, and by moving the movable member, the smoke outlet hole is opened or closed.

Further, the upper mouthpiece cover includes a main body, a suction part provided on the main body, and an inner lining member provided in the main body. The smoke outlet hole is provided in the main body. The air exiting hole is provided in the suction part. The inner lining member is provided with an air passage groove. The smoke outlet hole communicates with the air exiting hole through the air passage groove.

Further, the movable member is a rotating member, the rotating member is rotatably connected to the inner lining member, and by rotating the rotating member, the smoke outlet hole is opened or closed.

Further, the upper mouthpiece cover further includes a rotating shaft, the rotating member is rotatably connected to the inner lining member through the rotating shaft, and an axial direction of the rotating shaft is parallel or perpendicular to an axial direction of the upper mouthpiece cover.

Further, the movable member is a sliding member, the sliding member is slidably provided on the inner lining member, and by sliding the sliding member, the smoke outlet hole is opened or closed.

Further, the main body is provided with a matching groove communicating with the outside. The sliding member is provided with a protrusion. The protrusion passes through the inner lining member and extends into the matching groove to slide in the matching groove, and when the protrusion slides, the sliding member is driven to slide.

Further, the sliding member is provided with an anti-slip pattern on one side away from the suction part.

Further, the mouthpiece assembly further includes a lower mouthpiece cover. The lower mouthpiece cover is provided with a first air inlet passage and a first air outlet passage. The upper mouthpiece cover is movable relative to the lower mouthpiece cover. When the upper mouthpiece cover is in a first connection state relative to the lower mouthpiece cover, the first air inlet passage is in communication with the outside and the first air outlet passage is in communication with the air exiting hole, and when the upper mouthpiece cover is in a second connection state relative to the lower mouthpiece cover, the first air inlet passage and the first air outlet passage are closed by the upper mouthpiece cover.

A fourth aspect of the present invention provides an electronic cigarette including the mouthpiece assembly according to any one of the foregoing third aspect.

A fifth aspect of the present invention provides an atomizer including an atomizing assembly and a scraping member. The atomizing assembly includes a heating pan provided with an atomizing chamber containing an aerosol-forming substrate. The atomizer is provided on one side of the heating pan with a receiving groove for receiving the scraping member, and the scraping member can be taken out from the receiving groove.

Further, the scraping member includes a scraping portion and a resisting portion protruding from one end of the scraping portion. The scraping portion is received in the receiving groove, and the resisting portion is disposed at an opening of the receiving groove.

Further, the atomizer further includes a casing and a ventilation assembly received in the casing. The ventilation assembly is provided with an air inlet channel and an air outlet channel. Both the air inlet channel and the air outlet channel are in communication with the atomizing chamber.

Further, the receiving groove is formed by at least part of the air inlet channel or at least part of the air outlet channel.

Further, the atomizing assembly further includes an atomizing bottom cover. The atomizing bottom cover is detachably covered on one end of the heating pan.

Further, the atomizing bottom cover includes a cover body and a blocking hood connected to the cover body.

Further, an elastic member is installed in the receiving groove, and the elastic member is telescopically disposed between a bottom of the receiving groove and the scraping member.

Further, the atomizing assembly further includes a bottom seat connected to one end of the casing. The atomizing bottom cover is detachably mounted to the bottom seat. The bottom seat is provided with a penetrating hole corresponding to the receiving groove and communicating with the receiving groove. One end of the scraping member passes through the penetrating hole and resists the cover body.

Further, a top wall of the heating pan is provided with air inlet holes, and the atomizing bottom cover is provided with air outlet holes. The air inlet holes are in communication with the air inlet channel and the atomizing chamber. The air outlet holes are in communication with the air outlet channel and the atomizing chamber.

A sixth aspect of the present invention provides an electronic cigarette including the atomizer according to any one of the foregoing fifth aspect.

A seventh aspect of the present invention provides an electronic cigarette. The electronic cigarette includes an atomizing assembly, a power supply device, a ventilation assembly, and a mouthpiece assembly. The mouthpiece assembly and the atomizing assembly are respectively disposed at the upper and lower ends of the power supply device. The atomizing assembly is provided with an atomizing chamber. The ventilation assembly is disposed between the mouthpiece assembly and the atomizing assembly. The ventilation assembly includes an air inlet pipe and an air outlet pipe received in the air inlet pipe. The air inlet pipe and the air outlet pipe are both located on one side of the power supply device and are in communication with the atomizing chamber.

Further, an air inlet channel is formed between the inner wall of the air inlet pipe and the outer wall of the air outlet pipe. An air outlet channel is formed in the inner cavity of the air outlet pipe. The air inlet channel and the air outlet channel are both in communication with the atomizing chamber.

Further, the ventilation assembly further includes an adaptor installed at one end of the air inlet pipe, and one end of the air outlet pipe penetrates through the adaptor. A side wall of the adaptor is provided with a bypass hole. The bypass hole communicates with the air inlet channel and the atomizing chamber.

Further, the air inlet channel and the air outlet channel communicate with opposite ends of the atomizing chamber, respectively.

Further, the atomizing assembly includes an atomizing head and an atomizing bottom cover. The atomizing head includes a heating pan. The atomizing chamber is provided in the heating pan. The atomizing bottom cover is provided to cover the lower end of the heating pan. A top wall of the heating pan is provided with air inlet holes, and the atomizing bottom cover is provided with air outlet holes. The air inlet holes are in communication with the air inlet channel and the atomizing chamber. The air outlet holes are in communication with the air outlet channel and the atomizing chamber.

Further, the atomizing assembly further includes a bottom seat provided at the lower end of the heating pan. The bottom seat is provided with an opening, and a side groove is provided in the bottom seat on one side of the opening. The atomizing bottom cover partially passes through the opening to cover the lower end of the heating pan. The air outlet channel communicates with the side groove.

Further, the atomizing assembly further includes a second partition plate. The second partition plate is provided with a ventilation groove. One end of the ventilation groove communicates with the bypass hole correspondingly, and the other end of the ventilation groove communicates with the atomizing chamber.

Further, the electronic cigarette further includes a casing. The mouthpiece assembly and the atomizing assembly are respectively provided at opposite ends of the casing. The mouthpiece assembly is provided with a first air inlet passage communicating with the air inlet channel and a first air outlet passage communicating with the air outlet channel.

Further, the ventilation assembly is received in the casing. An inner wall of the casing is provided with a clamping groove, and an outer wall of the air inlet pipe is provided with a clamping strip that cooperates with the clamping groove.

Further, a connecting plate is provided between the mouthpiece assembly and the atomizing assembly. The ventilation assembly and the power supply device are respectively located on opposite sides of the connecting plate.

An eighth aspect of the present invention provides an atomizing head. The atomizing head includes a heating element and a heating pan, and one end of the heating element penetrates through a wall of the heating pan and is inserted into an inside of the heating pan.

Further, there are at least two heating elements.

Further, the at least two heating elements are connected in parallel.

Further, the heating element is an aluminum nitride ceramic containing tungsten paste.

Further, the atomizing head includes an outer shell and an inner shell. The inner shell is received in the outer shell. The heating pan is installed in the inner shell. The heating pan is provided with the atomizing chamber. A gap is formed between the inner wall of the outer shell and the outer wall of the inner shell.

Further, a top wall of the heating pan is provided with air inlet holes communicating with the atomizing chamber. The atomizing head further includes a top cover detachably mounted on the upper end of the outer shell. The top cover is provided with a ventilation hole communicating with the air inlet holes.

A ninth aspect of the present invention provides an atomizing assembly including the atomizing head according to any one of the foregoing eighth aspect.

Further, the atomizing assembly further includes a second partition plate, a bottom seat, an outer shell, and an atomizing bottom cover. The outer shell is sandwiched between the second partition plate and the bottom seat. The atomizing bottom cover is mounted on the bottom seat to cover the lower end of the atomizing chamber. The bottom seat is provided with an opening corresponding to the heating pan. The atomizing bottom cover includes a cover body and a blocking hood connected to the cover body. The cover body is detachably connected to the bottom seat. The blocking hood passes through the opening to cover the lower end of the atomizing chamber.

The beneficial effects of the present invention are: the mouthpiece assembly or the electronic cigarette provided by the present invention, when the upper mouthpiece cover is in the first connection state, the user can perform a suction operation; when the upper mouthpiece cover is in the second connection state, the smoke cannot flow out from the mouthpiece assembly, thereby avoiding the waste of smoke. It is easy and simple to operate, and also plays an environmental protection function.

BRIEF DESCRIPTION OF THE DRAWINGS

The present invention will be further described below with reference to the accompanying drawings and the embodiments.

Figure 1:
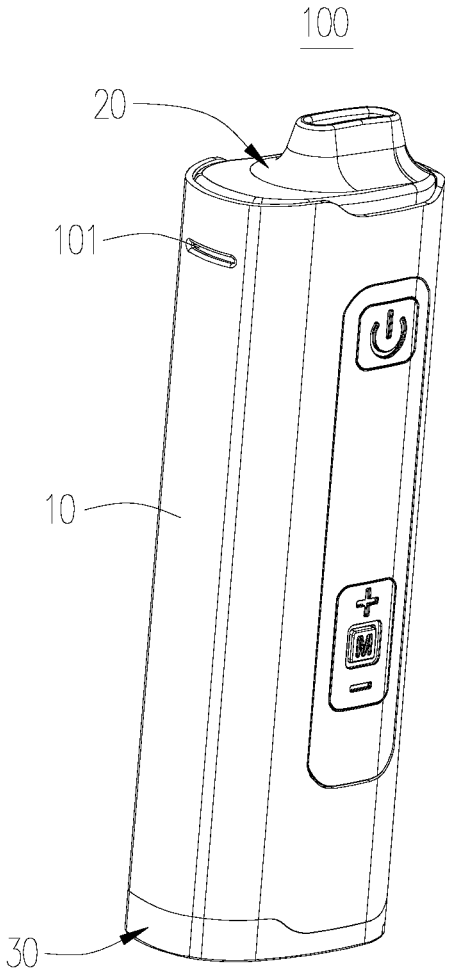
FIG. 1 is an isometric, schematic view of an electronic cigarette of the present invention.

The names and numbers of the parts in the drawings are as follows:

| | | |
|---|---|---|
| electronic cigarette 100 | casing 10 | air intake hole 101 |
| clamping groove 102 | connecting plate 11 | mouthpiece assembly 20 |
| first partition plate 21 | communicating hole 211 | lower mouthpiece cover 22 |
| recess 221 | first air outlet passage 223 | first air inlet groove 224 |
| second air inlet groove 225 | communicating groove 226 | upper mouthpiece cover 23 |
| main body 231 | suction part 233 | air exiting hole 2331 |
| first magnetic member 24 | second magnetic member 25 | atomizing assembly 30 |
| second partition plate 31 | ventilation groove 311 | atomizing head 32 |
| atomizing chamber 320 | bottom seat 33 | opening 331 |
| side groove 332 | atomizing bottom cover 34 | cover body 341 |
| blocking hood 342 | air outlet hole 3421 | outer shell 321 |
| top cover 322 | ventilation hole 3221 | inner shell 323 |
| heating pan 324 | air inlet hole 3241 | heating element 325 |
| first electrode 326 | second electrode 327 | thermal insulating cavity 328 |
| ventilation assembly 40 | air inlet pipe 41 | clamping strip 411 |
| air outlet pipe 42 | air outlet channel 420 | adaptor 43 |
| bypass hole 431 | scraping member 50 | power supply device 120 |
| scraping portion 51 | resisting portion 52 | sliding member 234 |
| inner lining member 235 | sealing member 236 | anti-slip pattern 2341 |
| indication mark 2342 | sliding groove 2351 | air passage groove 2352 |
| protrusion 2343 | rotating shaft 238 | rotating member 237 |
| smoke outlet hole 2311 | through hole 222 | air inlet channel 410 |
| penetrating hole 333 | matching groove 2312 | |

DETAILED DESCRIPTION OF PREFERRED EMBODIMENTS

The present invention will now be described in detail with reference to the accompanying drawings. These drawings are simplified schematic views and only illustrates the basic structure of the present invention in a schematic manner, so it only shows the structures related to the present invention.

Figure 2:
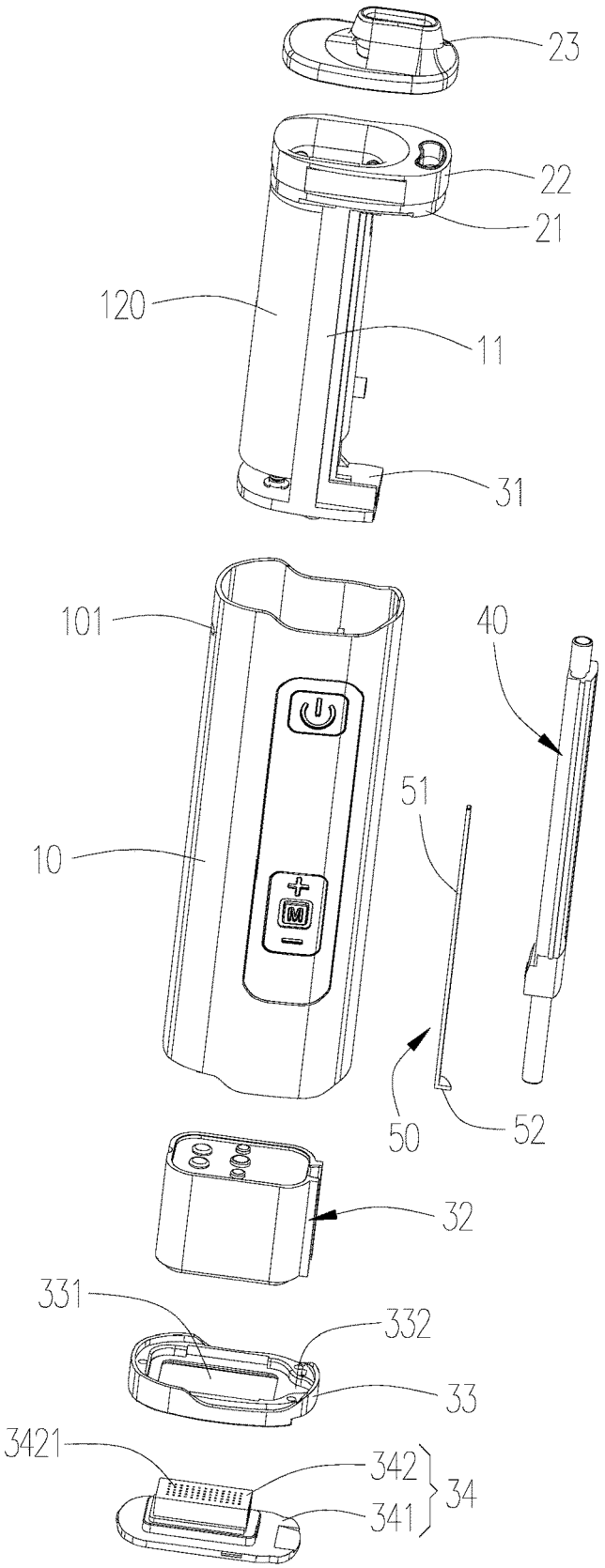
FIG. 2 is a partially exploded view of the electronic cigarette shown in FIG. 1.
Figure 12:
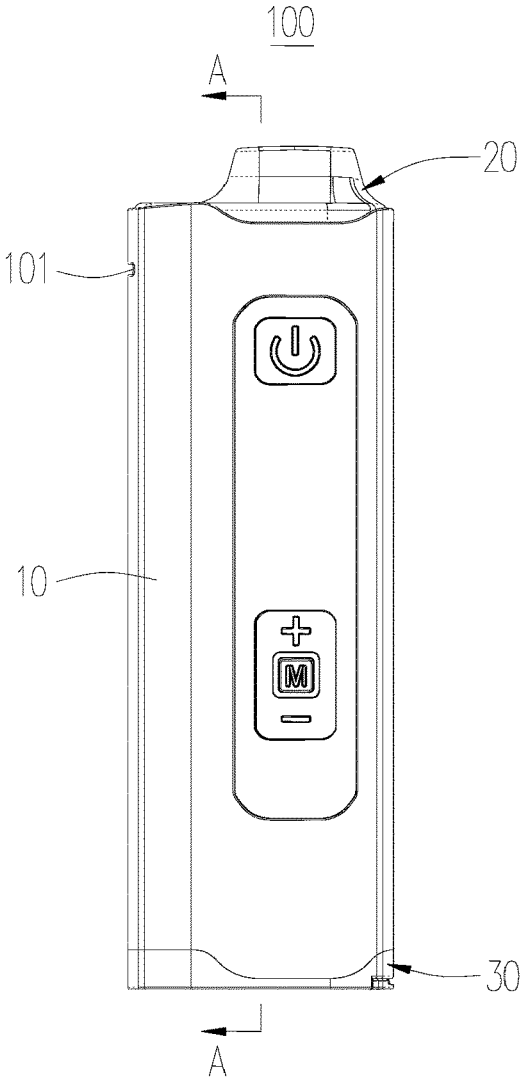
FIG. 12 is a front view of the electronic cigarette shown in FIG. 1.

Referring to FIG. 1, FIG. 2 and FIG. 12, the present invention provides an electronic cigarette 100. The electronic cigarette 100 includes an atomizer, a mouthpiece assembly 20 and a power supply device 120. The atomizer includes a casing 10, an atomizing assembly 30 and a ventilation assembly 40. The mouthpiece assembly 20 is disposed at one end of the casing 10, and the atomizing assembly 30 is disposed at the other end of the casing 10 opposite to the mouthpiece assembly 20. The ventilation assembly 40 is received in the casing 10 and communicated between the mouthpiece assembly 20 and the atomizing assembly 30. The power supply device 120 is electrically connected to the atomizing assembly 30. In use, the atomizing assembly 30 heats an aerosol-forming substrate (e.g., e-liquid, tobacco paste, tobacco shreds, etc.) under the electric driving of the power supply device 120, so that the aerosol-forming substrate is atomized to form smoke, and the smoke passes through the ventilation assembly 40 and enters the user's mouth through the mouthpiece assembly 20.

Figure 3:
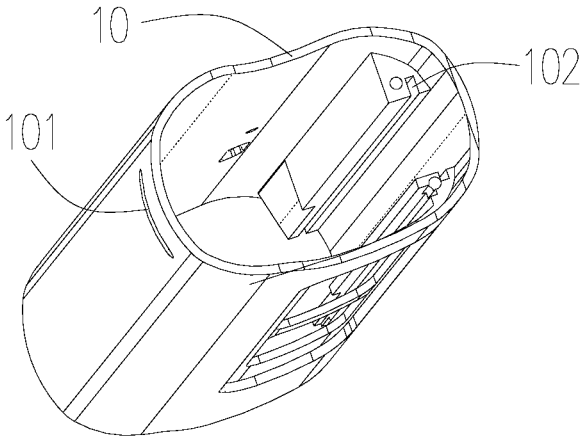
FIG. 3 is a schematic view of the casing in the electronic cigarette shown in FIG. 2.

Referring to FIG. 3, the casing 10 has generally a hollow cylindrical structure with openings at the upper and lower ends. An air intake hole 101 is provided in the side wall of the upper end of the casing 10. An inner wall of the casing 10 opposite to the air intake hole 101 is provided with a clamping groove 102, and the clamping groove 102 penetrates through the upper and lower ends of the casing 10.

Figure 4:
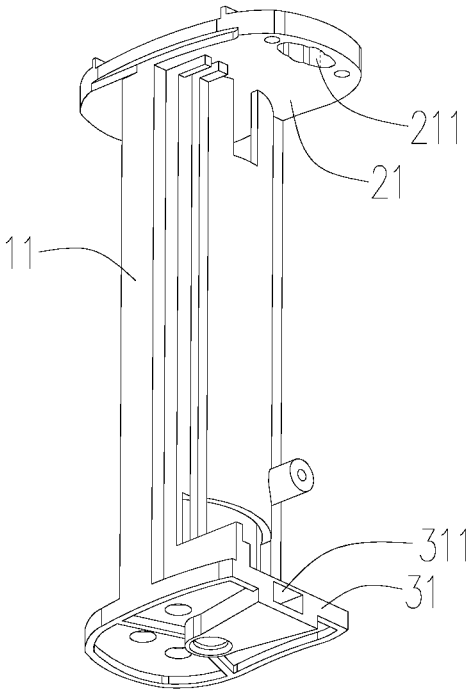
FIG. 4 is a schematic view of the connection structure of the first partition plate, the second partition plate and the connecting plate in the electronic cigarette shown in FIG. 2.
Figure 5:
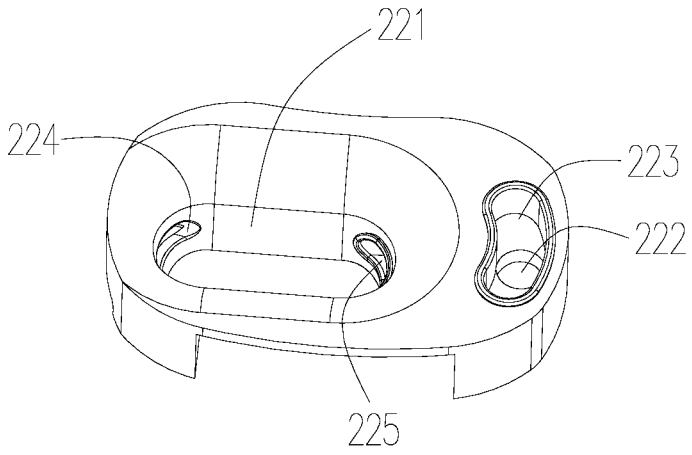
FIG. 5 is a schematic view of the lower mouthpiece cover in the mouthpiece assembly of the electronic cigarette shown in FIG. 2.
Figure 6:
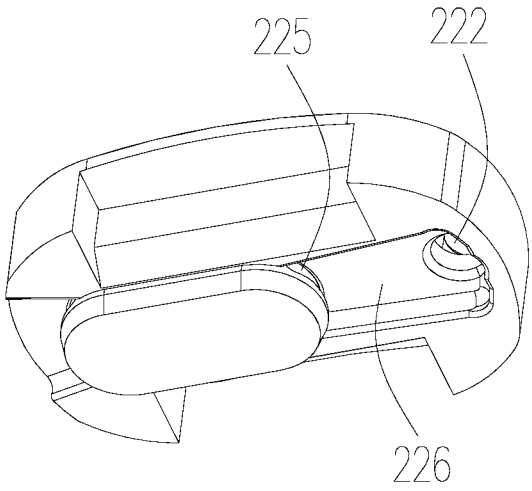
FIG. 6 is a schematic view of the lower mouthpiece cover shown in FIG. 5 from another viewing angle.

Referring to FIGS. 4-6 the mouthpiece assembly 20 includes a first partition plate 21 received in the upper end of the casing 10, a lower mouthpiece cover 22 provided on the first partition plate 21, and an upper mouthpiece cover 23 connected to the lower mouthpiece cover 22. The first partition plate 21, the lower mouthpiece cover 22 and the upper mouthpiece cover 23 are provided in this order from bottom to top.

Referring to FIG. 4, the first partition plate 21 has a generally plate-like structure. The first partition plate 21 is horizontally disposed at the upper end of the casing 10 and located below the air intake hole 101. One side of the first partition plate 21 away from the air intake hole 101 is provided with a communicating hole 211 which penetrates through the upper and lower surfaces of the first partition plate 21.

Referring to FIGS. 5-6, the lower mouthpiece cover 22 has generally a block structure with a waist-shaped cross section. The upper surface of the lower mouthpiece cover 22 is recessed downward to form a recess 221 with an upper end being open. On one side of the recess 221, the lower mouthpiece cover 22 is further provided with a through hole 222 penetrating through the upper and lower surfaces of the lower mouthpiece cover 22. Around the through hole 222, the upper surface of the lower mouthpiece cover 22 is recessed downward to form a first air outlet passage 223 communicating with the through hole 222. The lower surface of the lower mouthpiece cover 22 is further provided with a communicating groove 226 communicating with the through hole 222. Opposite walls of the recess 221 are respectively provided with a first air inlet groove 224 and a second air inlet groove 225 which are communicated through the recess 221. The first air inlet groove 224 penetrates through the side wall of the lower mouthpiece cover 22, and one end of the second air inlet groove 225 communicates with the communicating groove 226. When the first partition plate 21 and the lower mouthpiece cover 22 are installed in place, the first air inlet groove 224 communicates with the air intake hole 101 of the casing 10, and the communicating groove 226 communicates with the communicating hole 211. The first air inlet groove 224, the recess 221, the second air inlet groove 225, the communicating groove 226 and the communicating hole 211 together form a first air inlet passage (not labelled in the figures). It can be understood that the first air inlet passage is used for the external air to flow through and enter into the mouthpiece assembly 20, and the first air outlet passage 223 is used for the atomized smoke to flow through and enter into the mouthpiece assembly 20 so as to be finally sucked by the user. The specific structures of the first air inlet passage and the first air outlet passage 223 are not limited.

Figure 13:
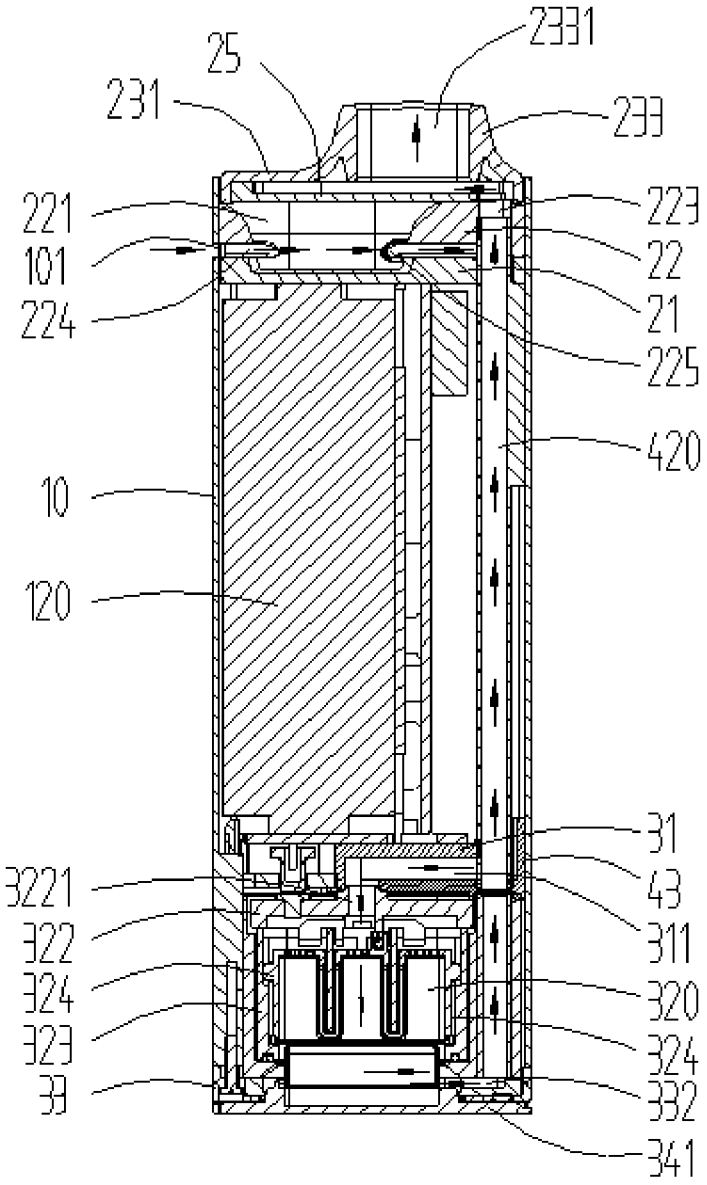
FIG. 13 is a cross-sectional view of the electronic cigarette shown in FIG. 12 (showing the upper mouthpiece cover is in the first connection state)
Figure 14:
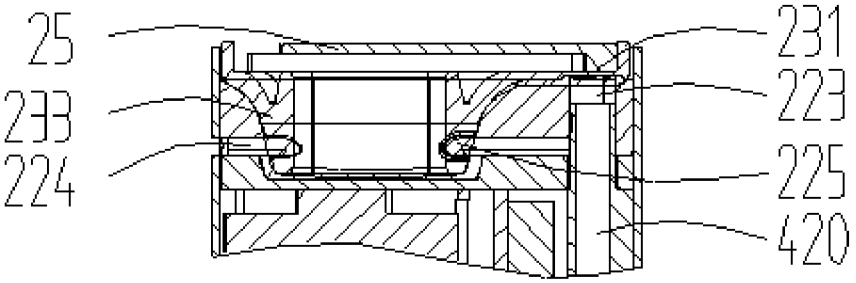
FIG. 14 is another cross-sectional view of the electronic cigarette shown in FIG. 12 (showing the upper mouthpiece cover is in the second connection state)
Figure 16:
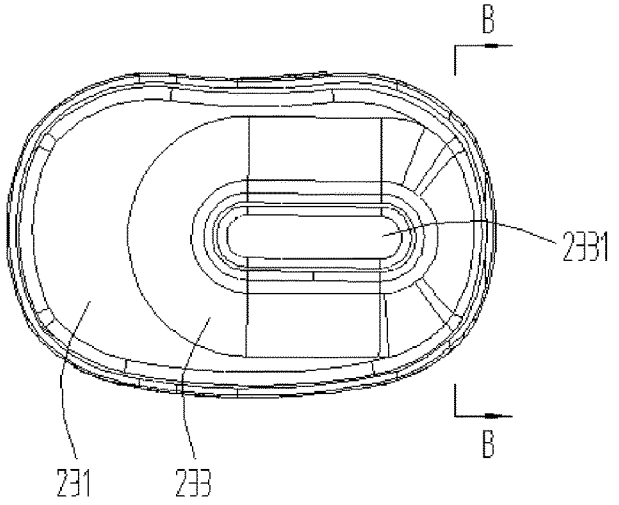
FIG. 16 is a top view of the electronic cigarette shown in FIG. 12.

Referring to FIG. 13, FIG. 14 and FIG. 16, the upper mouthpiece cover 23 includes a main body 231 and a suction part 233 protruding on the upper surface of the main body 231. The outer contour of the suction part 233 matches the shape of the recess 221 of the lower mouthpiece cover 22, and the suction part 233 is provided with an air exiting hole 2331. The upper mouthpiece cover 23 can move relative to the lower mouthpiece cover 22, that is, the upper mouthpiece cover 23 may be connected to the lower mouthpiece cover 22 in a first connection state or a second connection state. When the upper mouthpiece cover 23 is in the first connection state relative to the lower mouthpiece cover 22, the first air inlet passage and the first air outlet passage 223 can be used for air ventilation, the first air inlet passage is in communication with the outside and the first air outlet passage 223 is in communication with the air exiting hole 2331, so that the user can perform a suction operation; when the upper mouthpiece cover 23 is in the second connection state relative to the lower mouthpiece cover 22, the first air inlet passage and the first air outlet passage 223 are closed by the upper mouthpiece cover 23, so that the user cannot perform the suction operation. In this embodiment, when the upper mouthpiece cover 23 is in the first connection state relative to the lower mouthpiece cover 22, the air intake hole 101 is in communication with the first air inlet passage, and the air exiting hole 2331 is in communication with the first air outlet passage 223, so that the user can perform the suction operation using the suction part 233. During suction, the external air enters through the air intake hole 101 and the first air inlet passage, and then passes through the atomizing assembly 30 to carry the smoke to flow sequentially through the ventilation assembly 40, the first air outlet passage 223 and the air exiting hole 2331 to be finally brought out to the user's mouth; when the upper mouthpiece cover 23 is in the second connection state relative to the lower mouthpiece cover 22, the user cannot perform the suction operation, at this time, the suction part 233 cooperates with the recess 221 and the suction part 233 is at least partially accommodated in the recess 221, and the outer wall of the suction part 233 seals the first air inlet groove 224 and the second air inlet groove 225 respectively, thereby cutting off the communication between the first air inlet groove 224 and the second air inlet groove 225, that is, the suction part 233 closes the first air inlet passage so that the external air cannot flow through the first air inlet passage, and at the same time, the main body 231 closes the first air outlet passage 223, the smoke generated by the atomizing assembly 30 cannot flow out through the first air inlet passage or the first air outlet passage 223 when the user is not sucking, to avoid waste and also play an environmental protection function. It can be understood that, in other embodiments not shown, the outer wall of the suction part 233 may seal only one of the first air inlet groove 224 and the second air inlet groove 225 in order to cut off the communication between the first air inlet groove 224 and the second air inlet groove 225, thereby realizing the cutting off of the first air inlet passage.

It should be noted that, in order to further improve the smoke emission effect, the bottom of the main body 231 is provided with a smoke outlet hole (not labelled in the figures) corresponding to the air exiting hole 2331. When the upper mouthpiece cover 23 is in the first connection state relative to the lower mouthpiece cover 22, the lower end of the main body 231 is inserted into the recess 221, and the first air outlet passage 223 communicates with the air exiting hole 2331 through the smoke outlet hole.

In this embodiment, the main body 231 has substantially an oval shape. In other embodiments, the main body 231 may has other shapes such as a circle, a curved body, or a square.

In this embodiment, a cavity is provided inside the suction part 233.

In this embodiment, the user can change the first connection state or the second connection state of the upper mouthpiece cover 23 relative to the lower mouthpiece cover 22 by installing the upper mouthpiece cover 23 in a forward direction or a reverse direction. The operation is convenient and simple. It can be understood that, in other embodiments not shown, the upper mouthpiece cover 23 and the lower mouthpiece cover 22 may be rotatably connected, or the upper mouthpiece cover 23 and the lower mouthpiece cover 23 may be reversibly connected, or the upper mouthpiece cover 23 and the lower mouthpiece cover 22 may be slidably connected. When in use, the first and second connection states of the upper mouthpiece cover 23 relative to the lower mouthpiece cover 22 are changed by rotating or flipping or sliding the upper mouthpiece cover 23. The connection methods of the upper mouthpiece cover 23 and the lower mouthpiece cover 22 are not limited here, as long as the upper mouthpiece cover 23 can be switched between the first connection state and the second connection state relative to the lower mouthpiece cover 22. Optionally, the rotatable connection is that the upper mouthpiece cover 23 and the lower mouthpiece cover 22 are arranged coaxially, the upper mouthpiece cover 23 is sleeved outside or inside the lower mouthpiece cover 22, and the upper mouthpiece cover 23 can be rotated with respect to the lower mouthpiece cover 22 around a central axis of the lower mouthpiece cover 22; optionally, the reversible connection is that the upper mouthpiece cover 23 and the lower mouthpiece cover 22 can be rotated. In other embodiments, the upper mouthpiece cover 23 and the lower mouthpiece cover 22 may be connected by clamping and plugging.

It can be understood that, the lower mouthpiece cover 22 and/or the upper mouthpiece cover 23 may be made of elastic sealing materials such as rubber or silicone to ensure airtightness.

Figure 15:
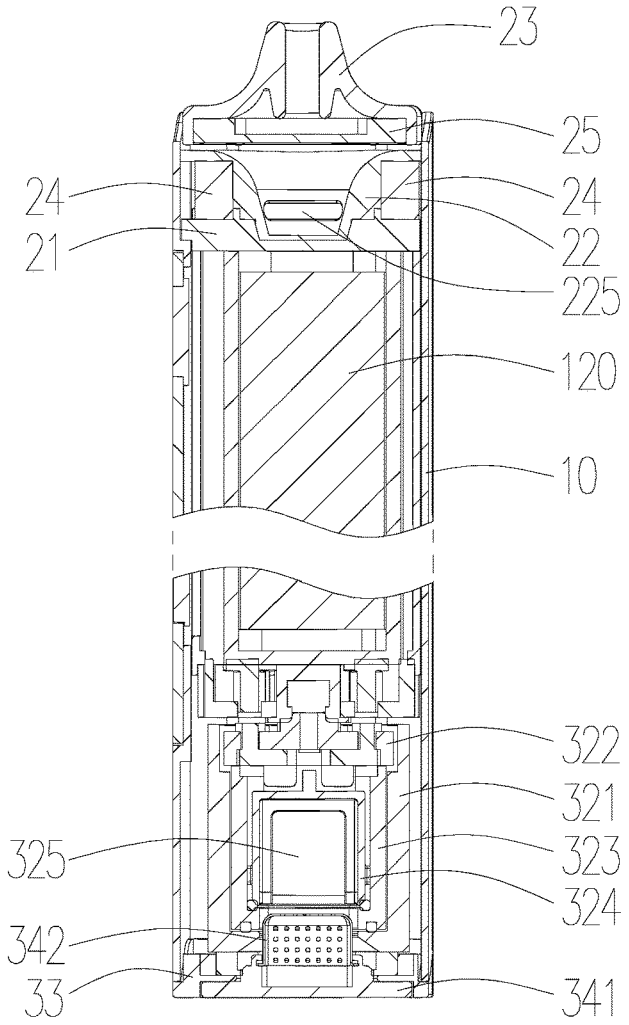
FIG. 15 is a cross-sectional view of the electronic cigarette shown in FIG. 12 along line A-A.

Further, referring to FIG. 15, the lower surface of the lower mouthpiece cover 22 is provided with two first magnetic members 24, the lower end of the upper mouthpiece cover 23 is provided with a second magnetic member 25. When the upper mouthpiece cover 23 is in the use state (i.e., the first connection state) or the non-use state (i.e., the second connection state) relative to the lower mouthpiece cover 22, both the first magnetic member 24 and the second magnetic member 25 can be magnetically attracted, so that the upper mouthpiece cover 23 and the lower mouthpiece cover 22 are connected stably and reliably, thereby further ensuring air tightness. In this embodiment, both the first magnetic member 24 and the second magnetic member 25 are magnets.

In this embodiment, the second magnetic member 25 is accommodated in the lower end of the upper mouthpiece cover 23. Further, the second magnetic member 25 is disposed at the bottom of the main body 231. When the upper mouthpiece cover 23 is in the first connection state relative to the lower mouthpiece cover 22, the lower end of the second magnetic member 25 covers the recess 221 to isolate the recess 221 from the air exiting hole 2331. Further, the second magnetic member 25 is provided with a through hole (not shown in the figures). When the upper mouthpiece cover 23 is in the first connection state relative to the lower mouthpiece cover 22, the through hole is respectively in communication with the first air outlet passage 223 and the smoke outlet hole to facilitate outflow of the air.

Figure 7:
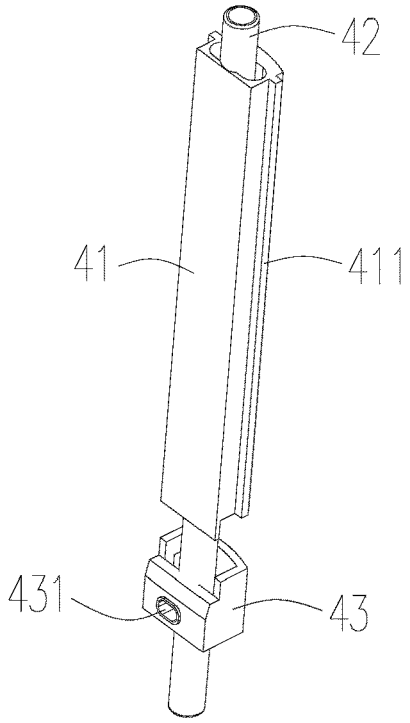
FIG. 7 is a partially exploded view of the ventilation assembly in the electronic cigarette shown in FIG. 2.

Referring to FIG. 7, the ventilation assembly 40 includes an air inlet pipe 41, an air outlet pipe 42 penetrating through the air inlet pipe 41, and an adaptor 43 provided at one end of the air outlet pipe 42.

Figure 8:
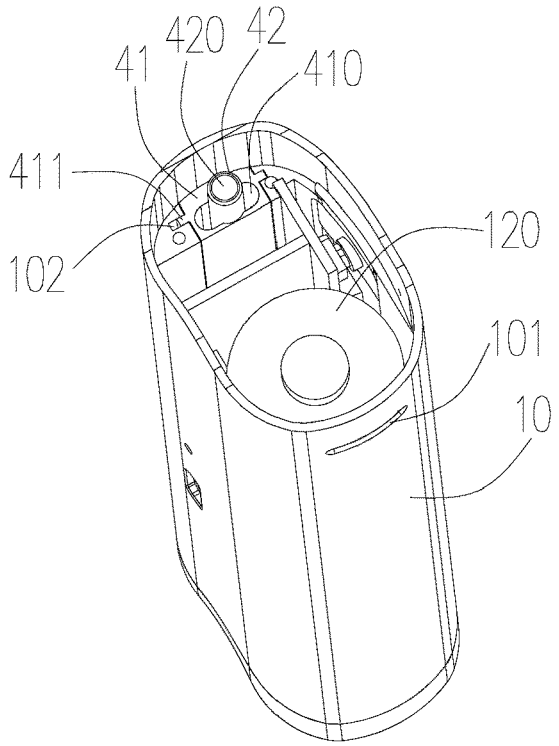
FIG. 8 is a schematic view of the electronic cigarette shown in FIG. 1 omitting the mouthpiece assembly.

Referring to FIG. 8 and FIG. 13, the air inlet pipe 41 is generally a hollow tubular structure with two open ends. The opposite outer walls of the air inlet pipe 41 is protruded to provide a clamping strip 411 that cooperates with the clamping groove 102 of the casing 10. The clamping strip 411 is inserted into the clamping groove 102 so as to realize the connection between the air inlet pipe 41 and the casing 10. The air outlet pipe 42 has a tubular structure, the air outlet pipe 42 penetrates through the inner cavity of the air inlet pipe 41, and the upper and lower ends of the air outlet pipe 42 extend to the outside of the air inlet pipe 41. A space (not labelled) is formed between the inner wall of the air inlet pipe 41 and the outer wall of the air outlet pipe 42, the space forms an air inlet channel 410, and the inner cavity of the air outlet pipe 42 forms an air outlet channel 420. When the air inlet pipe 41 is installed in place, the upper end of the air inlet pipe 41 abuts against the lower surface of the first partition plate 21, the first air inlet passage is in communication with the air inlet channel 410, the air outlet pipe 42 passes through the communicating hole 211 and is inserted into the through hole 222 of the lower mouthpiece cover 22, and the first air outlet passage 223 is in communication with the air outlet channel 420.

The adaptor 43 has a hollow cylindrical structure with an opening at its upper end. The adaptor 43 is installed to the lower end of the air inlet pipe 41 to seal the air inlet channel 410. The lower end of the air outlet pipe 42 penetrates through the bottom of the adaptor 43. One side of the adaptor 43 is provided with a bypass hole 431 communicating with the air inlet channel 410.

It can be understood that, the air inlet pipe 41, the air outlet pipe 42 and the adaptor 43 may also be integrally formed.

Figure 10:
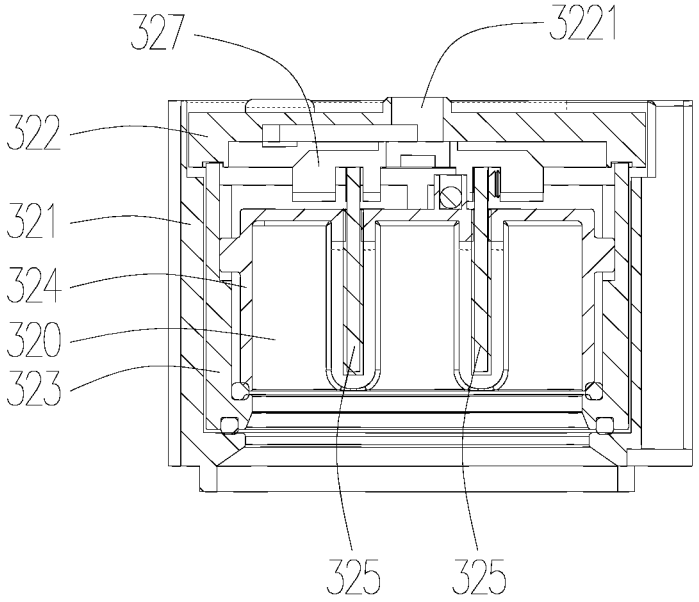
FIG. 10 is a cross-sectional view of the atomizing assembly in the electronic cigarette shown in FIG. 2 along a longitudinal direction.

Referring to FIG. 2 and FIG. 10 at the same time, the atomizing assembly 30 includes a second partition plate 31, an atomizing head 32 having an atomizing chamber 320, a bottom seat 33, and an atomizing bottom cover 34. The second partition plate 31 is horizontally disposed at the lower end of the casing 10. The bottom seat 33 is detachably installed at the lower end of the casing 10 to fix the atomizing head 32 between the second partition plate 31 and the bottom seat 33. The atomizing bottom cover 34 is detachably installed on the bottom seat 33.

Referring to FIG. 4, the second partition plate 31 has a generally plate-like structure, and the second partition plate 31 is provided with a ventilation groove 311. Specifically, in this embodiment, one end of the ventilation groove 311 penetrates through the side wall of the second partition plate 31 to communicate with the bypass hole 431 correspondingly, and the other end of the ventilation groove 311 penetrates through the bottom wall of the second partition plate 31 to communicate with the atomizing chamber 320, so that the air inlet channel 410 communicates with the atomizing chamber 320 sequentially through the bypass hole 431 and the ventilation groove 311.

In this embodiment, a connecting plate 11 is connected between the first partition plate 21 and the second partition plate 31. The connecting plate 11 is vertically arranged, and the power supply device 120 and the ventilation assembly 40 are respectively located on opposite sides of the connecting plate 11, so that the overall length of the electronic cigarette 100 is reduced, which is convenient for carrying and transportation. It can be understood that, the first partition plate 21, the second partition plate 31 and the connecting plate 11 may be detachably connected or fixedly connected or integrally formed. By disposing the power supply device 120 between the mouthpiece assembly 20 and the atomizing assembly 30 and forming airflow passages on one side of the power supply device 120, not only the structure is compact, but also the length of the airflow passages is reasonably increased, such that the time of heat exchange between the air inlet channel 410 and the air outlet channel 420 is prolonged, the heat of the smoke in the air outlet channel 420 is allowed to be partially transferred to the air in the air inlet channel 410, such that the air entering the atomizing head 32 can have a certain heating effect on the aerosol-forming substrate while the smoke will not be too hot when it enters the user's mouth, thereby improving the energy utilization rate.

Figure 9:
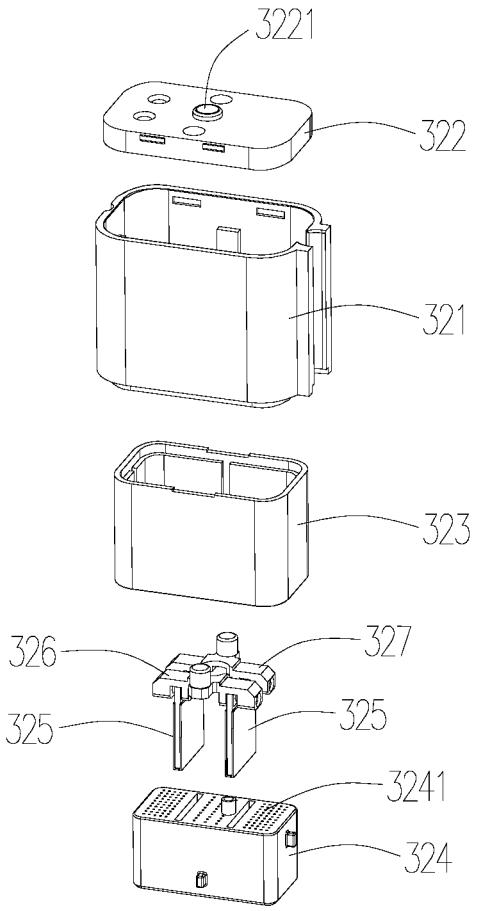
FIG. 9 is a partially exploded view of the atomizing assembly in the electronic cigarette shown in FIG. 2.
Figure 11:
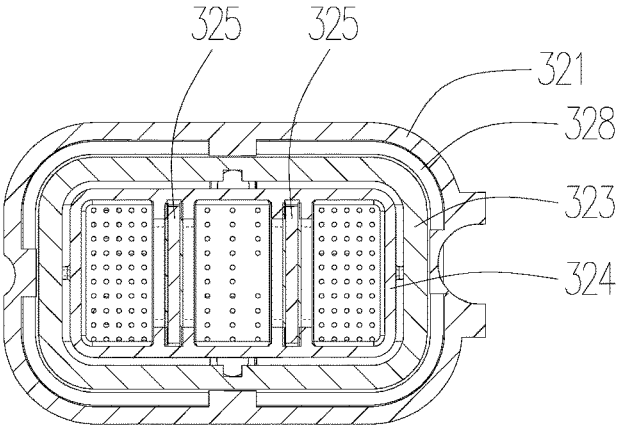
FIG. 11 is a cross-sectional view of the atomizing assembly in the electronic cigarette shown in FIG. 2 along a lateral direction.

Referring to FIGS. 9-11, the atomizing head 32 includes an outer shell 321, a top cover 322 installed at one end of the outer shell 321, an inner shell 323 received in the outer shell 321, a heating pan 324 installed inside the inner shell 323, a heating element 325 provided on the heating pan 324, and a first electrode 326 and a second electrode 327 connected to the heating element 325.

The outer shell 321 has a generally cylindrical structure with open upper and lower ends. The top cover 322 is detachably mounted on the upper end of the outer shell 321 by engaging. The inner shell 323 has a generally cylindrical structure with open upper and lower ends. A gap is formed between the inner wall of the outer shell 321 and the outer wall of the inner shell 323, and the gap forms a thermal insulating cavity 328. A gap is also formed between the outer wall of the heating pan 324 and the inner wall of the inner shell 323, and the gap also has the same thermal insulation effect as the thermal insulating cavity 328. It can be understood that, the top cover 322 may also be detachably connected to the outer shell 321 by plugging, screw connection, or the like.

The heating pan 324 generally has a hollow cylindrical structure with an opening at the lower end, and the atomizing chamber 320 is formed by the inner cavity of the heating pan 324 for containing an aerosol-forming substrate. The top wall of the heating pan 324 is provided with at least one air inlet hole 3241 communicating with the atomizing chamber 320, and the top cover 322 is provided with a ventilation hole 3221 communicating with the air inlet holes 3241. When the atomizing head 32 is installed in place, the top cover 322 abuts against the second partition plate 31, and the ventilation hole 3221 communicates with the ventilation groove 311, so that the air inlet channel 410 communicates with the atomizing chamber 320 sequentially through the bypass hole 431, the ventilation groove 311, the ventilation hole 3221 and the air inlet holes 3241.

The heating element 325 is disposed in contact with the heating pan 324. The heating pan 324 is made of a thermally conductive material (e.g., a metal material such as stainless steel or copper, or a non-metallic material such as ceramic), and the heating element 325 is made of an electrically conductive material having resistance. In this embodiment, the heating element 325 is made of conductive ceramics. Further, the heating element 325 includes tungsten. In this embodiment, an aluminum nitride ceramic sheet containing tungsten paste is used as the heating element 325, so that a temperature rise when heating is in line with the linear rule, which is more conducive to atomizing the aerosol-forming substrate. It can be understood that, in other embodiments, a metal material may also be used as the heating element 325, which may be nickel-chromium alloy, tungsten wire, or the like. In this embodiment, the heating element 325 has a plate-like structure and has two. The lower ends of the two heating elements 325 penetrate through the top wall of the heating pan 324 and are inserted into the heating pan 324 in parallel. The first electrode 326 and the second electrode 327 are detachably mounted on the upper ends of the two heating elements 325, and are electrically connected to the two heating elements 325. Optionally, the heating element 325 is engaged with the first electrode 326 and the second electrode 327. In this way, the two heating elements 325 form a parallel relationship. It can be understood that when the first electrode 326 and the second electrode 327 are disposed on the upper part of the heating pan 324, the heating element 325 penetrates through the top wall of the heating pan 324. In other embodiments, the first electrode 326 and the second electrode 327 may also be disposed on the side or bottom of the heating pan 324, and correspondingly, the heating element 325 penetrates through the side wall or bottom wall of the heating pan 324. The first electrode 326 and the second electrode 327 are each connected to an electrode post (not labelled in the figures). When the atomizing head 32 is installed in place, the electrode post on the first electrode 326 is electrically connected to one of the positive and negative electrodes of the power supply device 120, and the electrode post on the second electrode 327 is electrically connected to the other of the positive and negative electrodes of the power supply device 120, so that the heating element 325 can generate heat under the electric driving of the power supply device 120. The heating element 325 can heat the heating pan 324 under the action of heat transfer, and finally the heating pan 324 has approximately the same temperature as the heating element 325. The aerosol-forming substrate filled in the atomizing chamber 320 is then atomized to generate smoke under the heating action of the heating pan 324 and the heating element 325, causing the atomizing chamber 320 to be filled with smoke. It can be understood that, in other embodiments, there may be three or more heating elements 325, and the heating elements 325 may be electrically connected in parallel or series.

When the heating pan 324 and the heating element 325 are installed, only one end of the heat element 325 needs to penetrate through the top wall of the heating pan 324 to be accommodated in the inside of the heating pan 324, and the operation is simple and convenient. In addition, there are at least two heating elements 325. During operation, the heat generated between the heating elements 325 can be transferred to each other, which further increases the heating efficiency of the heating elements 325, avoids excessive heat loss, and enhances the effect of atomizing the aerosol-forming substrate.

It can be understood that, in other embodiments not shown, the heating element 325 may also be provided on the inner wall of the heating pan 324, or on the outer wall of the heating pan 324, or within the wall body of the heating pan 324, which are given no limitations herein. It can be understood that, when the heating element 325 is disposed on the outer wall of the heating pan 324 or within the wall body of the heating pan 324, the possibility of the aerosol-forming substrate directly contacting the heating element 325 is reduced, and the service life of the heating element 325 is prolonged.

It can be understood that, in other embodiments not shown, the heating element 325 may also be an infrared radiation device installed in the atomizing chamber 320 of the heating pan 324, for example, an infrared radiation tube, etc. During operation, the infrared radiation device emits infrared radiant heat to heat the aerosol-forming substrate under the electric driving of the power supply device 120.

During the heating of the heating pan 324, part of the heat of the heating pan 324 is transferred to the inner shell 323. Since a thermal insulating cavity 328 is provided between the inner shell 323 and the outer shell 321, the contact area between the inner shell 323 and the outer shell 321 is reduced to lower the efficiency of heat transfer from the inner shell 323 to the outer shell 321, thereby having a thermal insulation effect, reducing heat loss, and improving heat utilization. Furthermore, in one embodiment, both the outer shell 321 and the inner shell 323 are made of thermal insulation materials, such as foam, fiberglass, or asbestos, to reduce heat transfer and further reduce heat loss.

Referring to FIG. 2 and FIG. 13 again, the bottom seat 33 has a substantially disc-shaped structure. The bottom seat 33 is detachably mounted to the lower end of the casing 10 by bolts (not labelled), and the lower end of the outer shell 321 abuts against the upper surface of the bottom seat 33, thereby fixing the atomizing head 32 between the second partition plate 31 and the bottom seat 33. It can be understood that, in other embodiments not shown, the bottom seat 33 may also be detachably connected to the casing 10 by clamping or pressing. The bottom seat 33 is provided with an opening 331 which corresponds to the heating pan 324 and penetrates through the upper and lower ends of the bottom seat 33, and the upper surface of the bottom seat 33 is recessed to form a side groove 332 on one side of the opening 331.

The atomizing bottom cover 34 includes a cover body 341 and a blocking hood 342 connected to the upper surface of the cover body 341. The blocking hood 342 is provided corresponding to the heating pan 324. The cover body 341 is detachably connected to the bottom seat 33, and the blocking hood 342 passes through the opening 331 and is detachably covered on the lower end of the heating pan 324. The blocking hood 342 is generally a hollow box-shaped structure. The top wall of the blocking hood 342 and the side wall corresponding to the side groove 332 are provided with a plurality of air outlet holes 3421. In addition, the lower end of the air outlet pipe 42 passes through the adaptor 43 and is located at one side of the outer shell 321 and communicates with the side groove 332, at this time, the atomizing chamber 320 communicates with the air outlet channel 420 sequentially through the air outlet holes 3421 and the side groove 332. It can be understood that, the blocking hood 342 is provided to cover one end of the atomizing chamber 320 to prevent the aerosol-forming substrate and/or the residue after heating of the aerosol-forming substrate that is filled in the atomizing chamber 320 from leaking from the bottom of the atomizing chamber 320. Meanwhile, the air outlet holes 3421 formed on the blocking hood 342 can ensure smooth flow of the air.

In this embodiment, the cover body 341 is detachably connected to the bottom seat 33 by means of clamping. It can be understood that the cover body 341 can also be detachably connected to the bottom seat 33 by means of bolts, screws, or plugging. It can also be understood that the blocking hood 342 and the cover body 341 may be detachably connected or fixedly connected or integrally formed. When the user wants to fill the atomizing chamber 320 with the aerosol-forming substrate, the atomizing bottom cover 34 needs to be detached from the bottom seat 33 to open the lower port of the atomizing chamber 320 before the aerosol-forming substrate can be filled. It can be understood that, in this embodiment, a solid substance is used as the aerosol-forming substrate.

Figure 17:
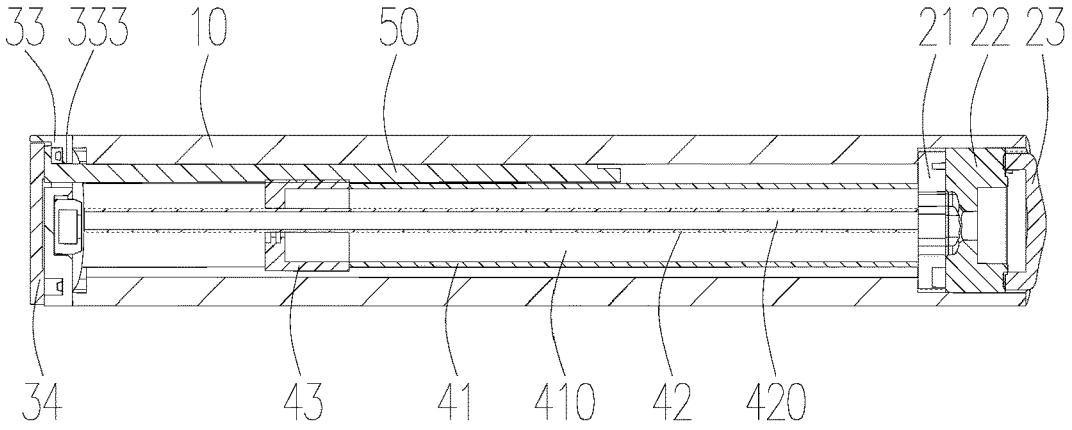
FIG. 17 is a cross-sectional view of the electronic cigarette shown in FIG. 16 along line B-B.
Figure 18:
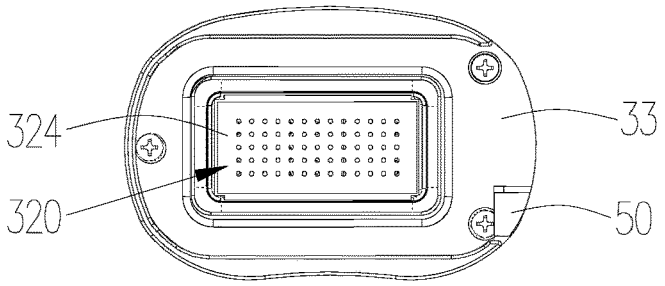
FIG. 18 is a bottom view of the electronic cigarette shown in FIG. 12 (omitting the atomizing bottom cover)
Figure 19:
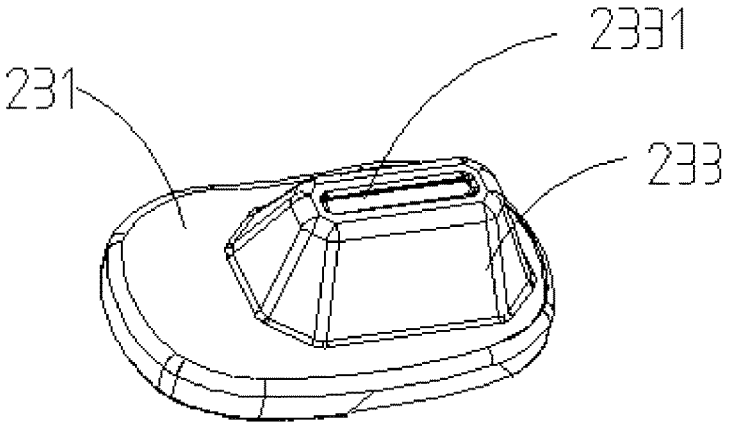
FIG. 19 is an isometric view of the upper mouthpiece cover in Embodiment 1 of the present invention.
Figure 20:
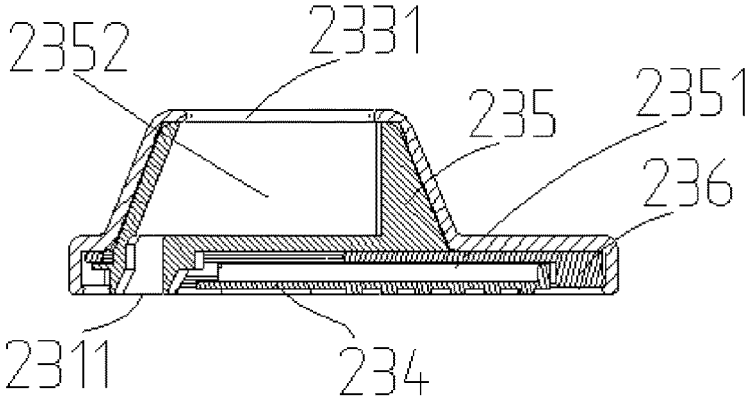
FIG. 20 is a cross-sectional view of the upper mouthpiece cover shown in FIG. 19.
Figure 21:
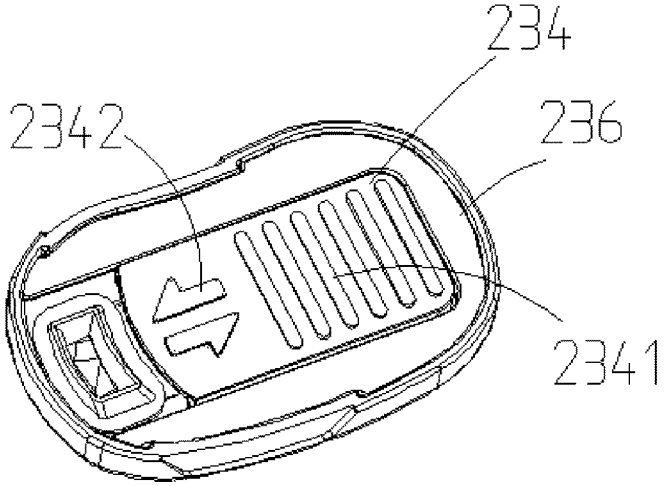
FIG. 21 is a schematic view of the upper mouthpiece cover shown in FIG. 19 when the smoke outlet hole is open.
Figure 22:
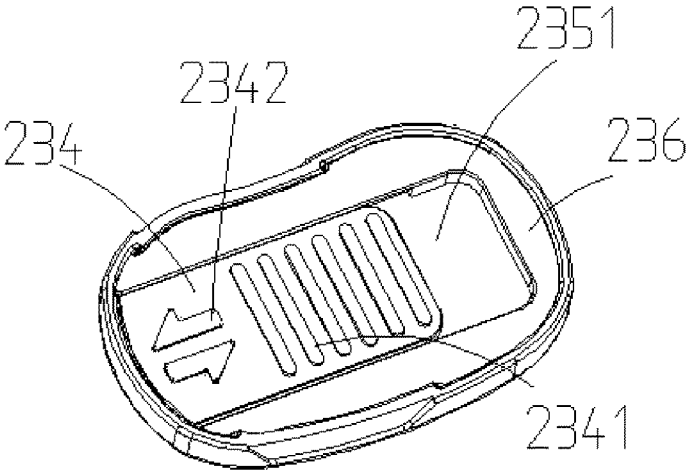
FIG. 22 is a schematic view of the upper mouthpiece cover shown in FIG. 19 when the smoke outlet hole is closed.

Referring to FIG. 2, FIG. 17 and FIG. 18, in order to facilitate the filling of the aerosol-forming substrate into the heating pan 324, the atomizer of the present invention further includes a scraping member 50. The scraping member 50 can be used as a scraping tool for scraping the aerosol-forming substrate into the atomizing chamber 320. It can be understood that, the scraping member 50 can also be used to clean out the residue of the aerosol-forming substrate remaining in the heating pan 324.

The atomizer is provided on one side of the heating pan 324 with a receiving groove (not labelled in the figures) for receiving the scraping member 50. One end of the receiving groove is provided with an opening, through which the scraping member 50 can be placed in or removed from the receiving groove. When the blocking hood 342 of the atomizing bottom cover 34 is placed to cover one end of the heating pan 324, the opening of the receiving groove is closed by the cover body 341, thereby holding the scraping member 50 inside the receiving groove to prevent the scraping member 50 from sliding out of the receiving groove and causing loss. When the atomizing bottom cover 34 is removed, the lower port of the heating pan 324 is opened, and the opening of the receiving groove is also opened. At this time, the user can take the scraping member 50 out of the receiving groove to perform filling operation of the aerosol-forming substrate. This operation does not require other filling tools except the electronic cigarette 100, the operation is simple and convenient for the user to operate.

Referring to FIG. 2 again, in this embodiment, the scraping member 50 includes a scraping portion 51 and a resisting portion 52 protruding from one end of the scraping portion 51. The scraping portion 51 has a generally rod-shaped structure, and the resisting portion 52 is formed by extending outward in the radial direction of the scraping portion 51. The scraping portion 51 is received in the receiving groove, and the resisting portion 52 is disposed at the opening of the receiving groove. Therefore, it is convenient for the user to take the scraping member 50 out of the receiving groove by pinching the resisting portion 52. In this embodiment, a part of the clamping groove 102 forms the receiving groove, and the bottom seat 33 is provided with a penetrating hole 333 corresponding to the receiving groove and communicating with the receiving groove. It can be understood that the part of the clamping groove 102 adjacent to the mouthpiece assembly 20 cooperates with the clamping strip 411, and the other part of the clamping groove 102 away from the mouthpiece assembly 20 forms the receiving groove. When the atomizing bottom cover 34 is placed to cover the heating pan 324, one end of the scraping member 50 passes through the penetrating hole 333 and resists the cover body 341 of the atomizing bottom cover 34. It can be understood that, in other embodiments not shown, the receiving groove may also be provided within the wall of the casing 10 on one side of the clamping groove 102, or may be formed by at least part of the air inlet channel 410 or at least part of the air outlet channel 420 of the ventilation assembly 40, thereby making the structure more compact. It can be understood that, it suffices so long as when the atomizing bottom cover 34 is removed, the lower port of the heating pan 324 and the receiving groove are opened simultaneously, and when the atomizing bottom cover 34 is installed, the lower port of the heating pan 324 and the receiving groove are closed simultaneously, there is no other limit herein.

It can be understood that, in other embodiments not shown, an elastic member (not shown) is installed in the receiving groove, and the elastic member is telescopically disposed between the bottom of the receiving groove and the scraping member 50. When the receiving groove is closed, the scraping member 50 abuts against the atomizing bottom cover 34 under the elastic force of the elastic member; when the receiving groove is opened, the scraping member 50 can be automatically ejected out of the receiving groove by the elastic force of the elastic member to facilitate the user to take out the scraping member 50. In this embodiment, the elastic member is a spring. It can be understood that the elastic member may also be an elastic and rigid element such as a thin steel sheet, which is not limited herein.

Referring to FIG. 13 again, when the user sucks the electronic cigarette 100, the external air sequentially enters into the air inlet channel 410 of the ventilation assembly 40 from the air intake hole 101 and the first air inlet passage of the mouthpiece assembly 20 sequentially, and then enters into the atomizing chamber 320 from the upper end of the atomizing assembly 30 to mix with the smoke. The mixed air flows out of the atomizing chamber 320 from the lower end of the atomizing assembly 30, and then enters into the air outlet channel 420, and finally passes through the first air outlet passage 223 and the air exiting hole 2331 of the mouthpiece assembly 20 sequentially to enter the user's mouth.

During the flowing of airflow, it flows through the entire heating pan 324 from top to bottom to ensure that the smoke in the atomizing chamber 320 can be taken out as much as possible, so as to improve the user experience. Further, the temperature of the external air entering the air inlet channel 410 is low. However, since the air outlet pipe 42 penetrates through the air inlet pipe 41, the air in the air inlet channel 410 and the air outlet channel 420 can exchange heat, that is, part of the heat of the mixed air in the air outlet channel 420 is transferred to the air in the air inlet channel 410, so that the temperature of the air in the air inlet channel 410 rises, thereby playing a preheating role, improving the utilization rate of heat, and reducing energy consumption. At the same time, due to the dissipation of heat of the mixed air in the air outlet channel 420, the temperature of the air entering the user's mouth will not be too high to prevent the user from being scalded.

In order to ensure that the heat of the airflow in the air outlet pipe 42 can be transferred to the air inlet pipe 41 through the air outlet pipe 42, the air outlet pipe 42 is made of a thermally conductive material. It can be understood that the thermally conductive material may be silver, copper, aluminum or other metal materials, or it may also be non-metallic materials such as diamond and silicon, which is not limited herein. In this embodiment, the air outlet pipe 42 is made of aluminum, which has light weight and low cost, and can effectively control the production cost.

The electronic cigarette 100 provided by the present invention can change the use state or the non-use state of the upper mouthpiece cover 23 relative to the lower mouthpiece cover 22 by installing the upper mouthpiece cover 23 in a forward or reverse direction. When the upper mouthpiece cover 23 is in the use state, the user can perform a suction operation; when the mouthpiece cover 23 is in the non-use state, smoke cannot exit from the mouthpiece assembly 20, which avoids waste of smoke, and at the same time plays an environmental protection function, and is convenient and simple to operate.

As can be seen from the foregoing description, when the upper mouthpiece cover 23 is in the second connection state, the first air inlet passage and the first air outlet passage 223 are closed by the upper mouthpiece cover 23, to prevent smoke from flowing out. However, a situation that may occur is that the second air inlet groove 225 is not tightly closed by the outer wall of the suction part 233, so that even if the upper mouthpiece cover 23 is in the second connection state, smoke will still pass through the second air inlet groove 225, the air exiting hole 2331 and the smoke outlet hole of the main body 231 to flow out. There may also be a situation in which it requires the user to stop smoking immediately on some occasions. However, the smoke remaining in the inner cavity of the suction part 233 will flow out through the smoke outlet hole of the main body 231. In order to avoid any of the above two situations, a movable member matching with the smoke outlet hole of the main body 231 may further be provided. When the upper mouthpiece cover 23 is in the second connection state relative to the lower mouthpiece cover 22, it can further use the movable member to close the smoke outlet hole of the main body 231. In the following, several specific implementations of the matching between the movable member and the smoke outlet hole will be given.

Embodiment 1

Referring to FIGS. 19-22, in this embodiment, the movable member is a sliding member 234, and the sliding member 234 is slidably provided at the bottom of the main body 231. The smoke outlet hole 2311 can be opened or closed by sliding the sliding member 234. It can be understood that the sliding member 234 may be a sliding block, a sliding plate, etc., which is not limited herein.

In order to install the sliding member 234, an inner lining member 235 is provided in the inner cavity of the upper mouthpiece cover 23, and a sliding groove 2351 is provided on the lower surface of the inner lining member 235, and the sliding member 234 is slidably installed in the sliding groove 2351. The inner lining member 235 is further provided with an air passage groove 2352 penetrating through the upper and lower surfaces of the inner lining member 235. The air passage groove 2352 is located on one side of the sliding groove 2351, and the air passage groove 2352 is in communication with the smoke outlet hole 2311 and the air exiting hole 2331, respectively. It can be understood that, in other embodiments not shown, the upper mouthpiece cover 23 and the inner lining member 235 are integrally formed.

In this embodiment, a sealing member 236 is further provided on the bottom of the main body 231. In this embodiment, the sealing member 236 is a U-shaped sealing plate with one end open, the inner surface of the sealing plate is disposed around the sliding groove 2351 and the air passage groove 2352, the open end of the sealing plate is located on the side of the air passage groove 2352, and the outer surface of the sealing plate is hermetically sealed with the inner wall of the main body 231 or the bottom edge of the main body 231. The sealing member 236 is made of a sealing material such as silicone, rubber or ceramics.

An anti-slip pattern 2341 is provided on one side of the sliding member 234 away from the suction part 233. Optionally, the anti-slip pattern 2341 is composed of multiple uneven grooves.

An indication mark 2342 is further provided on the side of the sliding member 234 away from the suction part 233. Optionally, the indication mark 2342 is composed of two parallel arrows arranged in opposite directions.

When smoking is required, the smoke outlet hole 2311 can be opened by sliding the sliding member 234 to cause the upper mouthpiece cover 23 in the first connection state relative to the lower mouthpiece cover 22, so that the first air inlet passage and the first air outlet passage 223 can be used for air ventilation. When smoking is not required, the upper mouthpiece cover 23 can be placed in the second connection state relative to the lower mouthpiece cover 22, so that the first air inlet passage and the first air outlet passage 223 are closed by the upper mouthpiece cover 23. Further, by sliding the sliding member 234 to close the smoke outlet hole 2311, the smoke can be prevented from flowing out of the smoke outlet hole 2311, and dust can also be prevented from entering the inner cavity of the upper mouthpiece cover 23 through the smoke outlet hole 2311, to achieve the effect of preventing dust and pollution.

Embodiment 2

Figure 23:
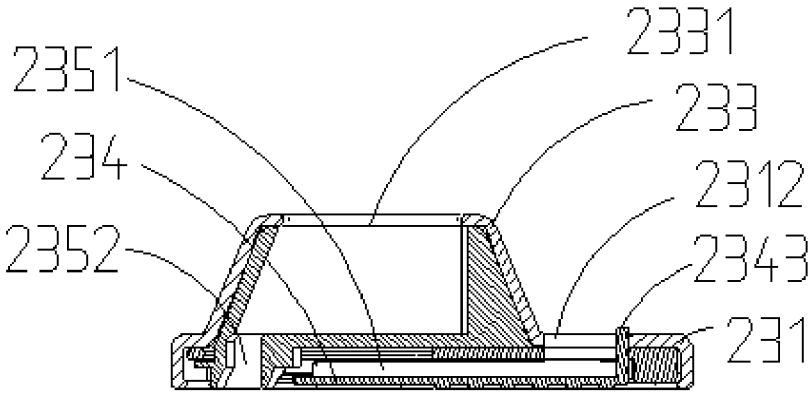
FIG. 23 is a cross-sectional view of the upper mouthpiece cover in Embodiment 2 of the present invention.
Figure 24:
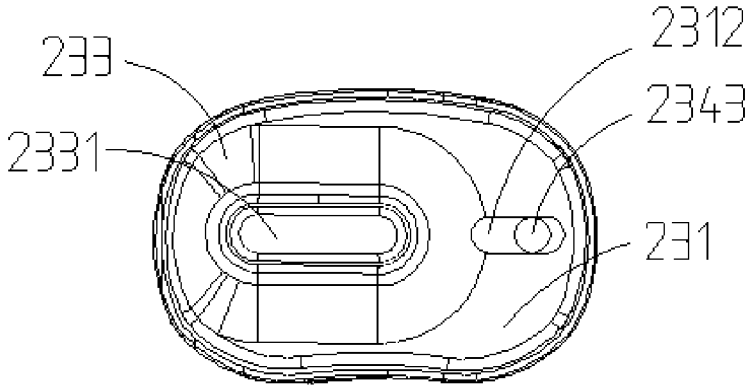
FIG. 24 is a top view of the upper mouthpiece cover shown in FIG. 23.

Referring to FIGS. 23 and 24, the difference between Embodiment 2 and Embodiment 1 is that the user can operate the sliding member 234 without removing the upper mouthpiece cover 23. Specifically, the main body 231 is provided with a matching groove 2312 penetrating through the upper and lower surfaces thereof, and the sliding member 234 is provided with a protrusion 2343. The protrusion 2343 passes through the inner lining member 235 and extends into the matching groove 2312, and can slide in the matching groove 2312. When the protrusion 2343 is slid to be located at one end of the matching groove 2312 away from the smoke outlet hole 2311, the sliding member 234 is located away from the smoke outlet hole 2311, and the smoke outlet hole 2311 is opened. When the sliding protrusion 2343 is slid to be located at one end of the matching groove 2312 adjacent to the smoke outlet hole 2311, the smoke outlet hole 2311 is closed by the sliding member 234. In this way, by providing a protrusion 2343 on the sliding member 234 that is convenient for the user to operate, the user can drive, through the protrusion 2343, the sliding member 234 to slide without the need of removing the upper mouthpiece cover 23, which is much convenient.

Embodiment 3

Figure 25:
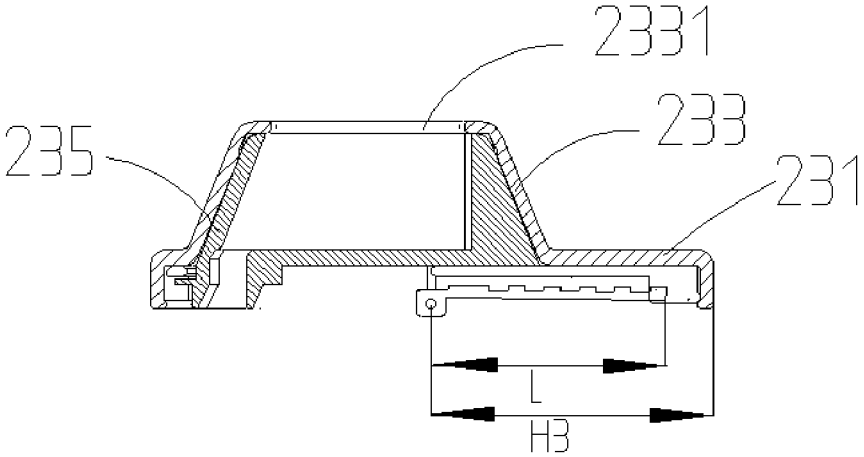
FIG. 25 is a cross-sectional view of the upper mouthpiece cover in Embodiment 3 of the present invention (the smoke outlet hole is open)
Figure 26:
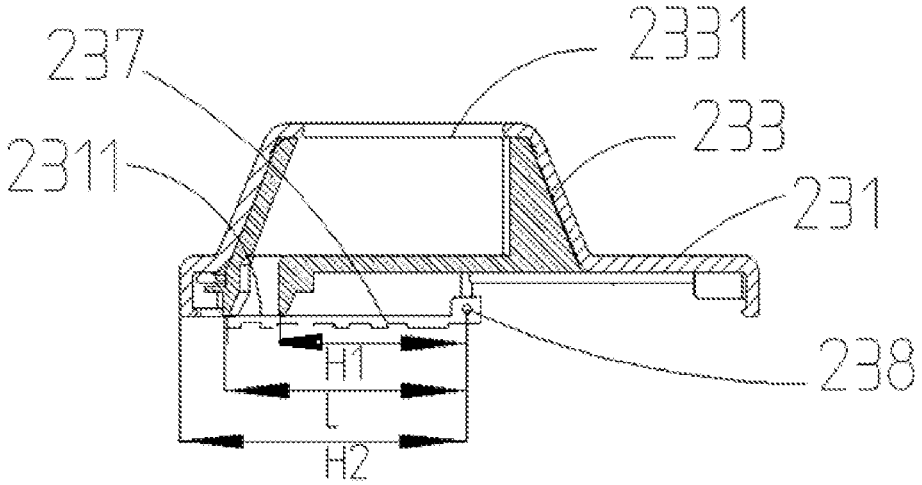
FIG. 26 is another cross-sectional view of the upper mouthpiece cover shown in FIG. 25 (the smoke outlet hole is closed)

Referring to FIGS. 25 and 26, the difference between Embodiment 3 and Embodiment 1 is that the movable member is a rotating member 237. Specifically, the upper mouthpiece cover 23 further includes a rotating shaft 238 provided at the bottom of the inner lining member 235. The rotating member 237 is rotatably connected to the inner lining member 235 through the rotating shaft 238, and the rotating member 237 can rotate around the rotating shaft 238. The rotating member 237 may open or close the smoke outlet hole 2311 by rotating the rotating member 237.

In this embodiment, the axial direction of the rotating shaft 238 is perpendicular to the axial direction of the upper mouthpiece cover 23. The distance from the rotating shaft 238 to the smoke outlet hole 2311 is H1, the length of the rotating member 237 is L, the distance from the rotating shaft 238 to the side of the main body 231 near the smoke outlet hole 2311 is H2, and the distance from the rotating shaft 238 to the side of the main body 231 away from the smoke outlet hole 2311 is H3, wherein $H1 \leq L \leq H2$ and $L \leq H3$. In this way, when the rotating member 237 is rotated toward the smoke outlet hole 2311, the rotating member 237 can close the smoke outlet hole 2311; when the rotating member 237 is rotated away from the smoke outlet hole 2311, the smoke outlet hole 2311 is opened, and the rotating member 237 is accommodated in the bottom of the main body 231.

In order to prevent the rotating member 237 from rotating arbitrarily, the end of the rotating member 237 away from the rotating shaft 238 is further provided with a locking tab (not shown), and the inner lining member 235 is provided with a first locking groove (not shown) and a second locking groove (not shown), when the rotating member 237 is rotated to close the smoke outlet hole 2311, the locking tab engages with the first locking groove, and when the rotating member 237 is rotated 180° to open the smoke outlet hole 2311, the locking tab is engaged with the second locking groove.

Embodiment 4

Figure 27:
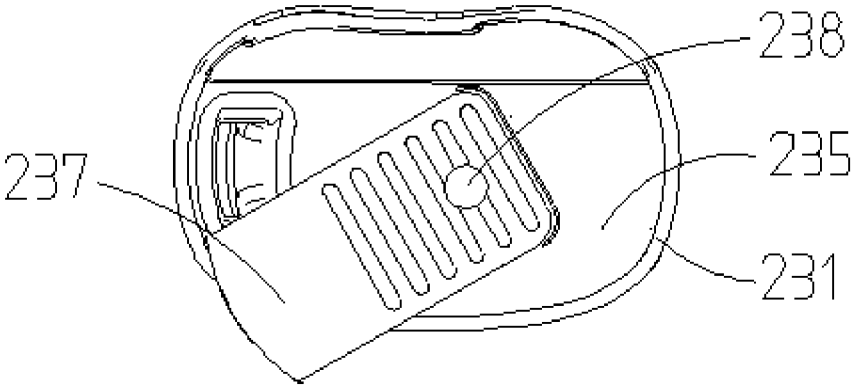
FIG. 27 is a schematic view of the upper mouthpiece cover in Embodiment 4 of the present invention.

Referring to FIG. 27, the difference between Embodiment 4 and Embodiment 3 is that the rotating manner of the rotating member 237 is different. Specifically, the axial direction of the rotating shaft 238 is parallel to the axial direction of the upper mouthpiece cover 23, so that when the rotating member 237 is rotated, the rotating member 237 rotates in a plane perpendicular to the central axis of the upper mouthpiece cover 23.

It can be understood that, in other embodiments not shown, the movable member may also be a cover detachably connected to the main body 231. When it is necessary to close the smoke outlet hole 2311, the cover is installed to the main body 231 so that the cover closes the smoke outlet hole 2311.

It is noted that when the communication between the air outlet path and the air exiting hole 2331 is isolated, or when the air exiting hole 2331 is closed, the user will not be able to suck through the air exiting hole 2331, so that it can prevent accidental suction. The smoke outlet hole 2311 of the main body 231 is a part of the air outlet path. In the above embodiments 1-4, by providing a movable member to open or close the smoke outlet hole 2311, the user can perform a smoking operation when the smoke outlet hole 2311 is opened, and when the smoke outlet hole 2311 is closed, it can prevent others (e.g., children) from smoking by mistake. Different from preventing the smoke from flowing out, in order to prevent the mistaken suction, it is only necessary to close the smoke outlet hole 2311 using the movable member, and whether the upper mouthpiece cover 23 is in the first connection state or the second connection state relative to the lower mouthpiece cover 22 is not limited.

It should be noted that the specific shapes of the upper mouthpiece cover 23 and the lower mouthpiece cover 22 of the present invention are not limited, and it only requires that the two are cooperated with each other. For example, the cooperating surfaces of the upper mouthpiece cover 23 and the lower mouthpiece cover 22 are round or oval or rectangular and so on.

Taking the above-mentioned embodiments of the present invention as inspiration, through the above description, the relevant persons can make various changes and modifications without departing from the scope of the present invention. The protection scope of the present invention is not limited to the contents of the description, and the protection scope must be determined according to the scope of the claims.

What is claimed is:

1. A mouthpiece assembly for an electronic cigarette, wherein the mouthpiece assembly comprises a lower mouthpiece cover and an upper mouthpiece cover, the lower mouthpiece cover is provided with a first air inlet passage and a first air outlet passage, the upper mouthpiece cover is provided with an air exiting hole, the upper mouthpiece cover is movable relative to the lower mouthpiece cover, when the upper mouthpiece cover is in a first connection state relative to the lower mouthpiece cover, the first air inlet passage is in communication with the outside and the first air outlet passage is in communication with the air exiting hole so that a user can perform a suction operation using the upper mouthpiece cover, and when the upper mouthpiece cover is in a second connection state relative to the lower mouthpiece cover, the first air inlet passage and the first air outlet passage are closed by the upper mouthpiece cover so that the user cannot perform the suction operation.

2. The mouthpiece assembly of claim 1, wherein the upper mouthpiece cover and the lower mouthpiece cover are rotatably connected, or the upper mouthpiece cover and the lower mouthpiece cover are reversibly connected, or the upper mouthpiece cover and the lower mouthpiece cover are slidably connected, or the upper mouthpiece cover and the lower mouthpiece cover are detachably connected.

3. The mouthpiece assembly of claim 1, wherein the lower mouthpiece cover and/or the upper mouthpiece cover are made of an elastic sealing material.

4. An electronic cigarette, wherein the electronic cigarette comprises the mouthpiece assembly of claim 1, the electronic cigarette further comprises an atomizing assembly, and the atomizing assembly is provided with an atomizing chamber.

5. The electronic cigarette of claim 4, wherein the electronic cigarette further comprises a ventilation assembly connected between the mouthpiece assembly and the atomizing assembly, the ventilation assembly is provided with an air inlet channel and an air outlet channel, two ends of the air inlet channel communicate with the first air inlet passage and the atomizing chamber, respectively, and two ends of the air outlet channel communicate with the first air outlet passage and the atomizing chamber, respectively.

6. The electronic cigarette of claim 5, wherein the electronic cigarette further comprises a casing, the mouthpiece assembly and the atomizing assembly are respectively provided at opposite ends of the casing, the ventilation assembly is received inside the casing, an air intake hole is provided in the casing, the air intake hole is in communication with the first air inlet passage and the outside.

7. The mouthpiece assembly of claim 1, wherein the lower mouthpiece cover is provided with a recess which is a part of the first air inlet passage, the upper mouthpiece cover comprises a main body and a suction part protruding from the main body, when the recess cooperates with the suction part, the first air inlet passage is closed by the upper mouthpiece cover, the air exiting hole is provided on the suction part.

8. The mouthpiece assembly of claim 7, wherein opposite walls of the recess are respectively provided with a first air inlet groove and a second air inlet groove, the first air inlet groove and the second air inlet groove communicate with each other through the recess, the first air inlet groove further communicates with the outside, the first air inlet passage further comprises the first air inlet groove and the second air inlet groove.

9. The mouthpiece assembly of claim 8, wherein the mouthpiece assembly further comprises a first partition plate provided on one side of the lower mouthpiece cover away from the upper mouthpiece cover, the first partition plate is provided with a communicating hole, the lower mouthpiece cover is provided with a communicating groove, two ends of the communicating groove communicate with the second air inlet groove and the communicating hole respectively, the first air inlet passage further comprises the communicating groove and the communicating hole.

10. The mouthpiece assembly of claim 8, wherein an outer contour of the suction part matches the shape of the recess, when the upper mouthpiece cover is in the second connection state relative to the lower mouthpiece cover, the suction part is at least partially accommodated in the recess, and an outer wall of the suction part seals at least one of the first air inlet groove and the second air inlet groove to cut off the communication between the first air inlet groove and the second air inlet groove.

11. The mouthpiece assembly of claim 7, wherein the lower mouthpiece cover is provided with a first magnetic member, the upper mouthpiece cover is provided with a second magnetic member capable of attracting the first magnetic member with each other.

12. The mouthpiece assembly of claim 11, wherein when the upper mouthpiece cover is in the first connection state relative to the lower mouthpiece cover, the second magnetic member covers the recess to isolate the recess from the air exiting hole.

13. A mouthpiece assembly, wherein the mouthpiece assembly comprises an upper mouthpiece cover, one end of the upper mouthpiece cover is provided with an air exiting hole, and the other end of the upper mouthpiece cover is provided with a smoke outlet hole communicating with the air exiting hole, a movable member is further provided on the upper mouthpiece cover to match with the smoke outlet hole, and by moving the movable member, the smoke outlet hole is opened or closed;

wherein the mouthpiece assembly further comprises a lower mouthpiece cover, the lower mouthpiece cover is provided with a first air inlet passage and a first air outlet passage, the upper mouthpiece cover is movable relative to the lower mouthpiece cover, when the upper mouthpiece cover is in a first connection state relative to the lower mouthpiece cover, the first air inlet passage is in communication with the outside and the first air outlet passage is in communication with the air exiting hole, and when the upper mouthpiece cover is in a second connection state relative to the lower mouthpiece cover, the first air inlet passage and the first air outlet passage are closed by the upper mouthpiece cover.

14. An electronic cigarette, wherein the electronic cigarette comprises the mouthpiece assembly of claim 13.

15. The mouthpiece assembly of claim 13, wherein the upper mouthpiece cover comprises a main body, a suction part provided on the main body, and an inner lining member provided in the main body, the smoke outlet hole is provided in the main body, the air exiting hole is provided in the suction part, the inner lining member is provided with an air passage groove, the smoke outlet hole communicates with the air exiting hole through the air passage groove.

16. The mouthpiece assembly of claim 15, wherein the movable member is a rotating member, the rotating member is rotatably connected to the inner lining member, and by rotating the rotating member, the smoke outlet hole is opened or closed.

17. The mouthpiece assembly of claim 16, wherein the upper mouthpiece cover further comprises a rotating shaft, the rotating member is rotatably connected to the inner lining member through the rotating shaft, and an axial direction of the rotating shaft is parallel or perpendicular to an axial direction of the upper mouthpiece cover.

18. The mouthpiece assembly of claim 15, wherein the movable member is a sliding member, the sliding member is slidably provided on the inner lining member, and by sliding the sliding member, the smoke outlet hole is opened or closed.

19. The mouthpiece assembly of claim 18, wherein the main body is provided with a matching groove communicating with the outside, the sliding member is provided with a protrusion, the protrusion passes through the inner lining member and extends into the matching groove to slide in the matching groove, and when the protrusion slides, the sliding member is driven to slide.

20. The mouthpiece assembly of claim 18, wherein the sliding member is provided with an anti-slip pattern on one side away from the suction part.

* * * * *